United States Patent [19]
Orlick et al.
[11] 4,318,270
[45] Mar. 9, 1982

[54] ADDITIVES FOR SUPPRESSING THE RADAR ATTENUATION OF ROCKET PROPELLANT EXHAUST PLUMES

[75] Inventors: Charles A. Orlick, LaVale; Edward H. deButts; John C. Allabashi, both of Cumberland; Stanley E. Sweeney, LaVale, all of Md.

[73] Assignee: The United States of America as represented by the Secretary of the Navy, Washington, D.C.

[21] Appl. No.: 721,141

[22] Filed: Apr. 11, 1968

[51] Int. Cl.[3] ..... C06D 5/00

[52] U.S. Cl. ..... 60/219; 60/220; 149/19.1; 149/19.8; 149/19.9; 149/19.91; 149/19.92; 149/22

[58] Field of Search ..... 60/219, 220; 149/19, 149/22, 19.1, 19.8, 19.9, 19.91, 19.92

[56] References Cited

U.S. PATENT DOCUMENTS

| | | | |
|---|---|---|---|
| 3,002,830 | 10/1961 | Barr | 149/19 |
| 3,022,149 | 2/1962 | Cramer | 149/19 |
| 3,028,271 | 4/1962 | Dixon et al. | 149/19 |
| 3,035,948 | 5/1962 | Fox | 149/19 |
| 3,087,844 | 4/1963 | Hudson et al. | 149/19 |
| 3,198,677 | 8/1965 | Thomas | 149/19 X |
| 3,219,498 | 11/1965 | Nitzsche et al. | 149/22 |
| 3,305,523 | 2/1967 | Burnside | 149/19 X |
| 3,326,732 | 6/1967 | Scurlock et al. | 149/19 |
| 3,351,505 | 11/1967 | Shapiro et al. | 149/19 |

*Primary Examiner*—Leland A. Sebastian
*Attorney, Agent, or Firm*—R. F. Beers; A. L. Branning

[57] ABSTRACT

A method for reducing radar attenuation caused by the formation of free electrons in the exhaust plume of a combusting high impulse rocket propellant which comprises contacting a microwave attenuation reducing additive having at least one element selected from the group consisting of Groups IIIA, IVA, VB, VIB, VIIB and VIII of the Periodic Table with said high impulse propellant. A novel propellant composition characterized by its combustion of low microwave attenuation properties. A class of additives useful for reducing the microwave attenuation characteristics of high impulse propellants.

3 Claims, No Drawings

ADDITIVES FOR SUPPRESSING THE RADAR ATTENUATION OF ROCKET PROPELLANT EXHAUST PLUMES

BACKGROUND OF THE INVENTION

This invention relates generally to additives for composite and composite-modified double-base propellants and more specifically to additives which effectively reduce the microwave attenuation caused by the formation of free electrons in the exhaust plume of a combusting high-impulse composite propellant or high-impulse composite-modified double-base propellant. This invention also relates to composite propellants and composite-modified double-base propellants which are characterized by combustion of low microwave attenuation properties. Finally, this invention relates to a novel method for reducing radar attenuation caused by the formation of free electrons in an exhaust plume of a combusting high-impulse rocket propellant.

One of the vital requirements of most missile guidance systems is the maintenance of maximum radar communication between a control station and the guidance control mechanism of the inflight rocket. Effective communication, however, is often quite severely distorted and even totally disrupted due to microwave attenuation or interference originating from the plume of the rocket exhaust. The plume is normally defined as the exhaust envelope or exhaust plasma which trails the rocket in a comet-like manner during its flight. Attenuation caused by the plume is generally believed to result from the formation of a high concentration of free electrons due to high temperature chemical and thermal ionizations. The interaction of the electromagnetic microwave signal with the exhaust gases, accelerates the free electrons to high velocities. Subsequent loss of this kinetic energy through inelastic collisions of electrons with heavier particles leads to attenuation of the microwave signal.

The prior art has discovered that one method for reducing the concentration of free electrons within the plume and thereby reduce the plume's microwave attenuation effect, is to decrease the temperature of the exhaust gases (which also corresponds to a decrease of the propellant's specific impulse). This enables the formation of the necessary stable exothermic combustion products which reduces the concentration of ions and consequently reduces the concentration of free electrons. The specific impulse is defined as the ratio of total impulse to the mass of the propellant and is generally proportional to the square root of the ratio of heat released to the molecular weight of the combustion products. This prior art solution, however, was generally unacceptable in view of the significant demand for propellants of very high impulse capable of propelling rockets of increased size and weight. To satisfy this demand the art has adopted such expedients as providing formulations containing large percentages of free metals; formulations having higher flame temperature; and formulations having a stoichiometric balance leading to metal oxide, carbon monoxide and hydrogen as stable exhaust products. All of these techniques for increasing specific impulse, however, tend to increase attenuation characteristics and hence are antithetical to the needs of guidance control and radar maintenance.

Prior attempts to control attenuation without sacrificing the energetics of the system have focused on such measures as lowering combustion chamber temperature, increasing chamber pressure, or overoxidizing the basic propellant mixture. These methods, however, also have proved generally unsatisfactory and are unacceptable since they fail to reduce attenuation to acceptable levels while retaining high propellant performance.

A need therefore exists in the propellant industry for a method of reducing radar attenuation of the type caused by the formation of free electrons in the exhaust plume of a combusting high-energy, high-impulse rocket propellant, which method will not deleteriously affect the specific impulse of the propellant composition.

SUMMARY OF THE INVENTION

It is therefore an object of this invention to provide a means for reducing radar attenuation in rocket exhaust plumes of high impulse propellants. It is also an object to provide a means for reducing radar attenuation in high-impulse composite and composite-modified double-base propellants.

It is another object to provide a method for reducing radar attenuation caused by the formation of free electrons in the exhaust plume of a combusting high impulse propellant.

It is also an object to provide a high impulse rocket propellant composition which is characterized by reduced radar attenuation on combustion.

Finally, it is an object of this invention to provide a microwave attenuation-reducing additive.

These and other objects are attained by providing a microwave attenuation-reducing additive which contains at least one compound having an active element selected from the elements of Groups IB, IIIA, IVA, VB, VIB, VIIB and VIII of the Periodic Table, and by combusting a high-impulse composite propellant or a high-impulse composite-modified double-base propellant while in contact with a minor portion of said attenuation additive.

DESCRIPTION OF THE PREFERRED EMBODIMENT

The microwave attenuation-reducing additives of this invention comprise a compound having at least one active element selected from the Groups IB, IIIA, IVA, VB, VIB, VIIB and VIII of the Periodic Table and more particularly comprising at least one compound having an active element selected from the group consisting of copper, boron, tin, lead, vanadium, chromium, molybdenum, tungsten, manganese, iron, cobalt and nickel.

Most preferred are the additives selected from the group consisting of $CoSnO_3.2H_2O$, $(NH_4)_2Cr_2O_7$, $K_2Cr_2O_7$, $CuCr_2O_7$, $PbCrO_4$, $B_4C$, BN, $MoO_3$, $V_2(SO_2)_5$, ammonium metavanadate and mixtures thereof as well as mixtures of CuO and $Cr_2O_3$. The mixture of CuO and $Cr_2O_3$ is preferrably in the weight ratio of 3:1 to 1.1.

Also included but less preferred are compounds of tungsten, managanese, iron and nickel. Typical compounds that would be expected to be operable here include: tungsten oxide, tungsten chloride, tungsten fluoride, manganese oxide, manganese chloride, manganese fluoride, permanganate salts, iron oxide, nickel oxide and nickel sulfate.

While it is not precisely understood why the additives of this invention reduce attenuation, it is believed that they have an effect on diminishing the electron concentration by capturing free electrons and by formation of stable compounds with alkali metals, thereby reducing the easily ionizable alkali metal impurities invariably present in most propellant compositions. It is also believed that one of the fundamental causes of chemical and thermal ionization, which leads to the formation of the high concentration of free electrons, is the afterburning effect of the fuel-rich exhaust products with atmospheric oxygen. Therefore, the high efficiency of these additives is believed to be attributable to the sheath of active elements which is formed along the outer boundary of the plume capturing free electrons before they are accelerated to high velocities.

The additives of this invention are effective in two broad classes of propellant compositions, the composite propellants and the composite-modified double-base propellants. The composite propellant comprises a mixture of finely divided oxidant in a matrix of a plastic, resinous or elastomeric fuel-binder composition. For this purpose a great variety of materials may be used as binders including asphalt, phenolic resin, polystyrene, synthetic rubber, such as butadiene-acrylic acid copolymer, urea-aldehyde resins, vinyl polymers, polyolefins, such as polyethylene and polypropylene, polybutadiene and carboxy-terminated polybutadiene, nitrocellulose and the like. Among oxidants which may be used include the perchlorates of ammonium, potassium, lithium and nitronium. Also included are the nitrates such as ammonium nitrate, potassium nitrate, lithium nitrate, hydrazine nitrate, the nitramines such as HMX and RDX, pentaerythritol tetranitrate, trinitrotoluene and others.

Additional metal fuels may be additionally added to the composite composition and these include the free metals of aluminum, beryllium, zirconium, lithium and aluminum/magnesium alloy, all of which tend to increase the propellant density and to improve specific impulse.

Double-base propellants are often referred to as homogeneous propellants and are usually considered true monopropellants, since, unlike the composite propellant, the binder contains both the fuel and oxygen necessary for combustion. The double-base propellant generally comprises nitrocellulose with at least one other nitroxy compound, such as nitroglycerin, nitroguanadine, diethyleneglycol dinitrate, 1,2,4-butanetriol trinitrate, 1,1,1-trimethylol ethane trinitrate, pentaerythitol trinitrate, dinitroglycerin and the like.

Stabilizers such as ethyl centralite, 2-nitrodiphenylamine (NDPA) and N-methyl paranitroaniline, and other additives such as carbon black as a darkening agent, candelilla wax as an extrusion aid and triacetin as a nitroglycerin desensitizer may also be added to the double-base composition.

Although the specific impulse of the double-base propellants normally are quite low, it can be substantially improved by the introduction of small quantities of oxidants of the type normally used in composite compositions. The double-base propellant upgraded in this manner is usually referred to as a composite-modified double-base propellant to account for the oxidant modifier.

The exact quantity of additive necessary for reducing radar attenuation is generally dependent on the particular additive selected and the particular propellant composition used. It has been found that attenuation is approximately proportional to the quantity of additive used in the system. Generally, as little as 0.5% of the additive, based on the weight of the total propellant composition, is effective. The maximum quantity is dependent on the degree of attenuation tolerable, with the upper limit being generally about 10% by weight of the total composition and more preferably about 5% by weight. Usually, quantities of between 0.9% to 4% will provide adequate reduction to radar attenuation for most communication systems.

A variety of methods may be used for introducing the additive into the exhaust plume, all of which are contemplated to be within the scope of this invention. For example, the additive may be incorporated into the propellant as an element or as a chemical compound. Alternatively, the additives may be combined with the rocket insulation, chamber wall or exhaust nozzle and thereafter permitted to enter the combustion product stream via the mechanism of heat erosion caused by the high combustion temperatures. Another method is to introduce the additive by means of ablation from separate solid charges containing substantial portions of the desired additives. One particularly good method is to inject a water solution of the additive into the rocket motor combustion chamber as a fine mist by means of a hydraulically driven piston which drives the additive dispersion at high pressures and at a uniform rate through a spray nozzle into the chamber. Having generally described the invention, the following examples are presented herein for purposes of illustration only and are not intended to be limiting in any manner.

In each of the following examples the aforesaid methods were used to introduce the additive into the exhaust plume. The maximum attenuation value obtained in the testing of an additive-modified composition was compared to the maximum attenuation value measured for the control composition. In Examples 10–22, the additive solution—injection method described above was used. For the purposes of these tests, the propellant was ignited and allowed to burn for about one second before the injection system was activated. Attenuation values were determined at approximately 0.1 seconds both before and after the injection phase. In measuring radar attenuation, three test facilities were used. Facility A measured microwave attenuation simultaneously at two frequencies, X-band (9.5 KMC) and $K_a$-band (28 KMC). During a firing the X and K attenuation signals were recorded on FM tape and digital tape. The FM tape allowed recording of the high frequency components while the digital recording was used for automatic data reduction by computer. Facility B comprised a highly stable system which measured attenuation and phase shift at $K_a$-band. The microwave frequency for this system was 28.2 KMC giving a focal radius of 1.0 inch to the 10 db points. Facility C comprised microwave absorption measurement instrumentation mounted inside an altitude chamber. A focused X-band system with twelve-inch diameter lenses having a focal diameter of approximately one-inch was used. Instrumentation included the following: two channels for attenuation, a high and a low gain channel; two channels for cabin pressure, a high and a low pressure channel; one channel for rocket motor position.

Using these test facilities, the following results were obtained.

EXAMPLES 1–3

For this system, a double-base propellant (designated EOH) was prepared:

| Composition | Parts by Weight EOH |
|---|---|
| Nitrocellulose | 28.0 |
| Nitroglycerin | 46.2 |
| Triacetin | 2.7 |
| Ammonium perchlorate | 21.0 |
| 2-nitrodiphenylamine | 1.0 |
| Resorcinol | 1.1 |

To this formulation microwave attenuation additives were incorporated with the following results as measured by Facility A:

| EXAMPLE | ADDITIVE % by Weight | SPECIFIC IMPULSE $I^o$(theor) 1000 | ATTENUATION DECIBELS/cm 6" from exit plume | 24" from exit plume |
|---|---|---|---|---|
| Control | — | 256 | 0.018 | 0.053 |
| 1 | 1.8% $(NH_4)_2Cr_2O_7$ | 253 | — | 0.021 |
| 2 | 1.7% $CuO/Cr_2O_3$ 82/17 | 253 | 0.014 | 0.000 |
| 3 | 1.8% $K_2Cr_2O_7$ | 253 | 0.011 | — |

EXAMPLES 4–7

The following formulations were prepared:

| Composition A & B | Parts by Weight A | B |
|---|---|---|
| Nitrocellulose | 28.0 | 28.8 |
| Nitroglycerin | 38.3 | 37.2 |
| Triacetin | 7.1 | 6.7 |
| Ammonium perchlorate | 17.1 | 20.2 |
| 2-nitrodiphenylamine | 1 | 1.0 |
| Resorcinol | 1 | 1.1 |
| Aluminum | 7.5 | — |
| 7 parts aluminum, 3 parts magnesium alloy | — | 5 |

The following additives were added to these formulations with the following results as measured by Test Facility B:

| Example | Basic Formulation | Additive | Specific Impulse $I^o$(theor) 1000 | Attenuation Decibels |
|---|---|---|---|---|
| $Control_1$ | A | — | 257 | 1.75 |
| 4 | A | 1% $B_4C$ | 257 | 0.7 |
| 5 | A | 2% $B_4C$ | 257 | 0.45 |
| 6 | A | 2% BN | 253 | 0.6 |
| $Control_2$ | B | — | 254 | 1.0 |
| 7 | B | 2% $B_4C$ | 252 | 0.23 |

EXAMPLES 8–9

The following formulation was prepared:

| Composition | Parts by Weight |
|---|---|
| Polybutadiene (carboxy-terminated) | 12 |
| Ammonium Perchlorate | 78 |
| Aluminum | 10 |

To this formulation, the following additives were incorporated and radar attenuation measurements made using Facility B with the following results:

| EXAMPLE | BASIC FORMULATION | ADDITIVE % BY WEIGHT | SPECIFIC IMPULSE $I^o$(theor) 1000 | ATTENUATION DECIBELS |
|---|---|---|---|---|
| $Control_3$ | C | — | 262 | 0.72 |
| 8 | C | 1.5% $MoO_3$ | 259 | 0.31 |
| 9 | C | 3.0% $MoO_3$ | 257 | 0.25 |

EXAMPLES 10–12

The following additives were injected into the above compositions with the following results as measured by Facility B:

| EXAMPLE | FORMULATION | ADDITIVE % by Weight | ATTENUATION DECIBELS |
|---|---|---|---|
| Control | B | — | 0.55 |
| 10 | B | 2.1% $Cu(NO_3)_2$ | 0.45 |
| 11 | B | 2.1% $Cr(NO_3)_3$ | 0.35 |
| 12 | B | 1.6% $(NH_4)_6Mo_4O_{24}$ | 0.08 |
| 13 | B | 0.7% $(NH_4)_6Mo_4O_{24}$ | 0.34 |
| 14 | B | 2.1% $(NH_4)_2W_4O_{13}$ | 0.41 |
| 15 | B | 2.1% $Mn(NO_3)_2$ | 0.52 |
| 16 | B | 2.1% $Fe(NO_3)_3$ | 0.29 |
| 17 | B | 2.1% $Co(NO_3)_2$ | 0.25 |
| 18 | B | 2.1% $Ni(NO_3)_2$ | 0.36 |
| Control | C | — | 0.40 |
| 19 | C | 2.1% $VOSO_4$ | 0.06 |
| 20 | C | 2.1% $(NH_4)_6Mo_4O_{24}$ | 0.11 |
| 21 | C | 3.1% $(NH_4)_2W_4O_{13}$ | 0.08 |
| 22 | C | 3.1% $Fe(NO_3)_3$ | 0.15 |

EXAMPLES 23–25

The following formulations were prepared:

| Composition | Parts by Weight FDR | FDW | FED |
|---|---|---|---|
| Nitrocellulose | 15.8 | 15.8 | 17.3 |
| Nitroglycerin | 26.8 | 26.8 | 28.2 |
| Triacetin | 6.7 | 6.7 | 6.7 |
| Ammonium perchlorate | 44.6 | 43.2 | 41.8 |
| 2-nitrodiphenylamine | 1.0 | 1.0 | 1.0 |
| Resorcinol | 1.5 | 1.5 | 1.4 |
| Aluminum | 3.6 | 5.0 | — |
| 7 parts aluminum, 3 parts magnesium alloy | | | 3.6 |

Lead chromate was formulated into these propellants with the following results as measured by Facility C at a simulated altitude of 25000 feet:

| EXAMPLE | BASIC FORMULATION | ADDITIVE % BY WEIGHT | SPECIFIC IMPULSE $I^o$(theor) 1000 | ATTENUATION DECIBELS/cm 20" aft of EXIT PLUME |
|---|---|---|---|---|
| Control | FDR | — | 255 | 0.070 |
| 23 | FDR | 1.9% $PbCrO_4$ | 252 | 0.041 |
| Control | FDW | — | 256 | 0.287 |
| 24 | FDW | 1.9% $PbCrO_4$ | 253 | 0.022 |
| Control | FED | — | 255 | 1.29 |
| 25 | FED | 1.9% $PbCrO_4$ | 252 | 0.022 |

The foregoing Examples 1–3, 11 and 23–25 indicate the effectiveness of chromium-containing compounds as radar attenuation suppressants. In general, although the specific impulse values of the additive containing propellants are only slightly lower than the same compositions without attenuation additives, the degree of attenuation as measured in decibels is substantially lower, often by as much as 95% as in the case of lead chromate.

Examples 4–7 relate to boron-containing compounds which are shown to reduce radar attenuation by as much as 75% when $B_4C$ is incorporated at the 2% level and as much as 60% when 1% $B_4C$ is used. BN is shown to be only slightly less beneficial than $B_4C$ and provides a 65% reduction in radar attenuation with only a corresponding 4 lbf-sec/lbw reduction in specific impulse.

Examples 8, 9, 12, 13 and 20 relate to the use of molybdenum additives in both composite and composite-modified double-base propellants. These examples show that as little as 1.5% and 3% molybdenum trioxide respectively will result in decreases in radar attenuation by as much as 65%. Examples 10, 14, 15, 16, 17, 18, 19, 21 and 22 relate to other additives such as the compounds of copper, tungsten, manganese, iron, cobalt, nickel and vanadium and show that similar reductions in microwave attenuation are obtained using these types of additives.

The foregoing description of the invention may be modified without departing from the spirit and scope thereof, and it is intended that the invention be limited only by the scope of the appended claims.

What is claimed as new and desired to be secured by Letters Patent of the United States is:

1. A method of reducing radar attenuation caused by the formation of free electrons in an exhaust plume of a combusting high impulse rocket propellant, comprising:
   adding to a high impulse propellant, selected from the group consisting of composite propellants and composite-modified double-base propellants, which produces free electrons in the exhaust plume, a minor portion of a microwave attenuation reducing additive, said additive consisting of a mixture of CuO and $Cr_2O_3$ in the weight ratio of 3:1 to 1:1.

2. A method of reducing radar attenuation caused by the formation of free electrons in an exhaust plume of a combusting high impulse rocket propellant, comprising:
   adding to a high impulse propellant, selected from the group consisting of composite propellants and composite-modified double-base propellants, which produces free electrons in the exhaust plume, a minor portion of a microwave attenuation reducing additive, said additive consisting of at least one compound containing an active element selected from the group consisting of those elements of Groups IB, IIIA, IVA, VB, VIB, VIIB and VIII of the Periodic Table; and wherein said microwave attenuation reducing additive is contacted with said combustion chamber simultaneously with combustion.

3. A method of reducing radar attenuation caused by the formation of free electrons in an exhaust plume of a combusting high impulse rocket propellant, comprising:
   adding to a high impulse propellant, selected from the group consisting of composite propellants and composite-modified double-base propellants, which produces free electrons in the exhaust plume a minor portion of a microwave attenuation reducing additive, said additive consisting of at least one compound containing an active element selected from the group consisting of those elements of Groups IB, IIIA, IVA, VB, VIB, VIIB and VIII of the Periodic Table; and wherein said microwave attenuation reducing additive is incorporated into the insulation of the combustion chamber and is contacted with the combusting propellant by heat erosion from said insulation.

* * * * *